US006289865B1

(12) United States Patent
Spix

(10) Patent No.: US 6,289,865 B1
(45) Date of Patent: Sep. 18, 2001

(54) OIL PUMP PICK-UP TUBE

(75) Inventor: Thomas Andrew Spix, Rochester Hills, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/592,833

(22) Filed: Jun. 13, 2000

(51) Int. Cl.[7] ..... F01M 9/08
(52) U.S. Cl. ..... 123/196 R; 123/195 C
(58) Field of Search ..... 123/196 R, 195 A, 123/195 C; 184/106

(56) References Cited

U.S. PATENT DOCUMENTS 3,592,293 * 7/1971 Frincke et al. ..... 123/196 R
5,065,487 11/1991 Yother ..... 29/275
5,301,642 * 4/1994 Matsushiro et al. ..... 123/196 AB
5,988,134 * 11/1999 Smietanski ..... 123/196 R
6,041,752 * 3/2000 Van Klompenburg ..... 123/195 C
6,142,257 * 11/2000 Bruener et al. ..... 184/12

* cited by examiner

*Primary Examiner*—Noah P. Kamen
*Assistant Examiner*—Hai Huynh
(74) *Attorney, Agent, or Firm*—Laura C. Hargitt; Leslie C. Hodges

(57) ABSTRACT

An oil pick-up tube for carrying oil from an oil reservoir to an oil pump, comprises an oil pick-up end disposed in the oil reservoir, a pump end disposed in the oil pump, and a transporting tube portion to deliver oil from the oil pick-up end to the pump end. The pump end includes an insert cylinder having outer diameter D and an oil outlet, an outer diameter d tube portion, and a flared portion tapering from the insert cylinder to the outer diameter d tube portion. The pick-up tube further comprises an o-ring seal disposed about the outer diameter d tube portion, wherein the diameter D of the insert cylinder is greater than the diameter d of the outer diameter d tube portion for keeping the o-ring seal about the tube prior to assembly with the oil pump.

6 Claims, 1 Drawing Sheet

OIL PUMP PICK-UP TUBE

TECHNICAL FIELD

This invention relates to an oil pump pick-up tube of an engine oil pump.

BACKGROUND OF THE INVENTION

An engine oil pump draws oil through an oil pick-up tube from an oil reservoir. This pick-up tube must seal against a housing, such as the pump housing or engine block, as any air leak will allow the pump to draw air instead of oil. This condition could result in engine issues if the engine main bearings are not adequately lubricated.

Therefore, an o-ring seal may be supplied pre-assembled to the pick-up tube to seal against the housing. Prior to installing the pick-up tube in the oil pump at an engine assembly plant, the o-ring may inadvertently roll off the end of the pick-up tube. If this occurs without being detected during assembly, major engine rebuild or replacement costs may be incurred.

One conventional alternative is to undercut the tube to retain the o-ring on the tube. The disadvantage to this alternative is the cost associated with undercutting. Therefore the need exists for a simple, inexpensive solution to keep the o-ring seal on the end of the pick-up tube prior to engine assembly.

SUMMARY OF THE INVENTION

The present invention is for an engine oil pump pick-up tube designed to retain its associated o-ring seal on the tube prior to engine assembly. The oil pick-up tube carries oil from an oil reservoir to an oil pump. It comprises an oil pick-up end disposed in the oil reservoir, a pump end disposed in the oil pump, and a transporting tube portion to deliver oil from the oil pick-up end to the pump end. The pump end includes an insert cylinder having outer diameter D and an oil outlet, an outer diameter d tube portion, and a flared portion tapering from the insert cylinder to the outer diameter d tube portion. The o-ring seal is disposed about the outer diameter d tube portion, wherein the diameter D of the insert cylinder is greater than the diameter d of the outer diameter d tube portion for keeping the o-ring seal about the tube prior to assembly with the oil pump. This prevents the potential harm to engine life which may result if the o-ring seal rolls off the pick-up tube during pre-assembly transportation or engine assembly. This solution is significantly less costly than undercutting the tube to retain the o-ring seal as this requires a secondary operation to perform the undercut.

DESCRIPTION OF THE PREFERRED EMBODIMENT

Figure 1:
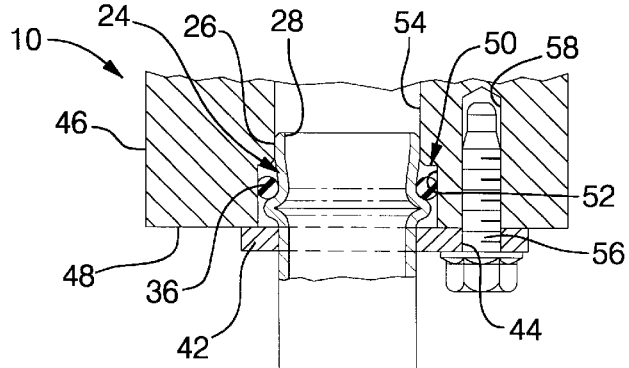
FIG. 1 is an illustration of an oil pick-up tube of the present invention installed in a portion of an engine pump for an engine.
Figure 1:
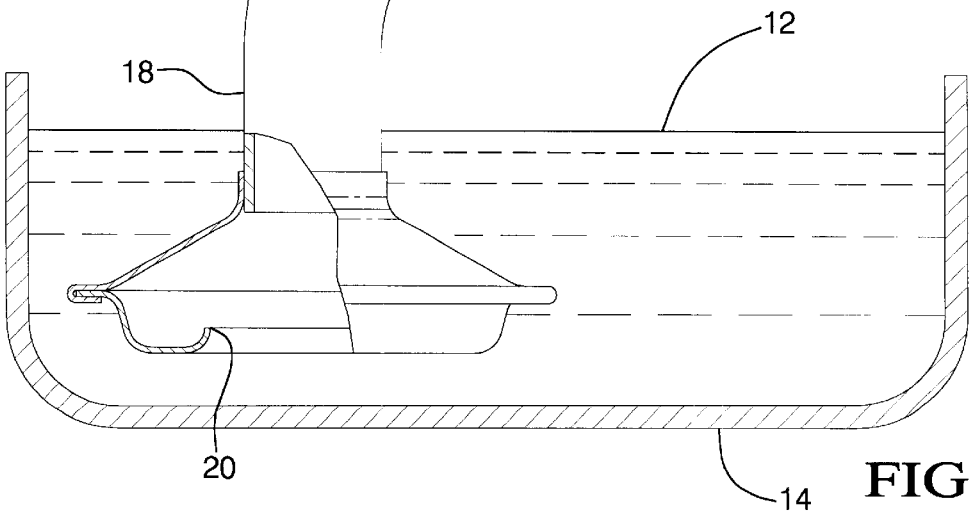

An engine is lubricated by an engine oil pump mounted therein. As shown in FIG. 1, the engine oil pump, generally 10, draws oil out of an oil reservoir 12 formed within an engine oil pan 14, through an oil pick-up tube 16, to distribute oil throughout the engine. The pick-up tube 16 may be made of steel to tolerate the oil environment.

The pick-up tube 16 is comprised of a generally constant diameter, transporting tube portion 22 to deliver oil from an oil pick-up end 18 of the tube to an opposing, pump end 24 of the tube. The oil pick-up end 18 has an oil inlet 20 disposed in the oil reservoir 12. A screen, not shown, is installed in the oil inlet 20 to filter particulates from the oil.

Figure 2:
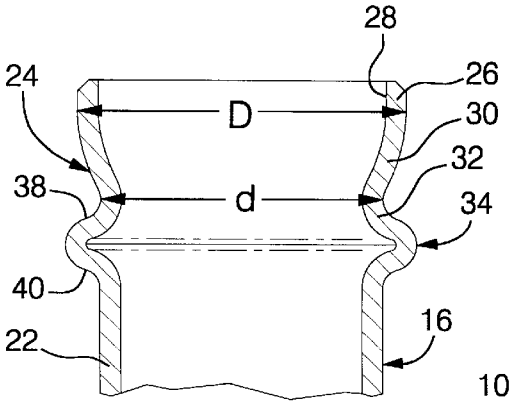
FIG. 2 is a sectional view of the pump end of the oil pick-up tube, exaggerated for clarification.

With reference to the exaggerated section in FIG. 2, the pump end 24 of the tube 16 is comprised of an insert cylinder 26 having an outer diameter 'D' and an oil outlet 28 in fluid communication with the transporting tube portion 22. The insert cylinder 26 is adjacent to a frustoconical or flared portion 30, tapering from the outer diameter 'D' to a narrower, outer diameter 'd' tube portion 32. Adjacent the narrower, outer diameter 'd' portion 32 is a locating formation 34 in the tube 16, accomplished as illustrated by compressing the transporting tube portion 22 and the insert cylinder 26 axially. The locating formation 34 operates as an axial locator for an o-ring seal 36 on an upper surface 38 of the locating formation and a radial mounting flange 42 on a lower surface 40 of the locating formation, as shown in FIG. 1.

The o-ring seal 36 is disposed circumferentially about the narrower, outer diameter 'd' portion 32 of the pump end 24 of the pick-up tube 16, intermediate the locating formation 34 and the insert cylinder 26. The o-ring seal 36 is pre-assembled to the tube 16 by slightly stretching the seal to fit over the insert cylinder 26 of the tube and rolling the seal down the frustoconical portion 30 to the narrower, outer diameter 'd' portion 32. The seal 36 seats against the upper surface 38 of the locating formation 34. Since the diameter D of the insert cylinder 26 is larger than the narrower, outer diameter d portion 32, the o-ring seal 36 will not be inadvertently rolled off the pump end 24 during shipping and handling prior to assembly with the pump 10. Although, FIG. 2 exaggerates the difference between the two diameters, a diameter D of about 23 mm and a narrower diameter d of about 22.3 mm, for example, may be sufficient to minimize the risk of the seal 36 coming off the pump end 24.

The radial mounting flange 42 extends about the transporting tube portion 22, adjacent the lower surface 40 of the locating formation 34. The mounting flange 42 may be fixed to the pick-up tube 16 by brazing or other method. A mounting hole 44 extends through the mounting flange 42.

The pump end 24 of the pick-up tube 16 is received in a housing 46 where the housing may be part of the oil pump or the engine block having a passage for delivering oil to the oil pump 10. The housing 46 of the oil pump 10 has a lower mating surface 48 with a stepped opening 50 for receiving the pump end 24 of the pick-up tube 16 and the o-ring seal 36. The stepped opening 50 has a cylindrical opening 52 of such a diameter to snugly receive the o-ring seal 36. The cylindrical opening 52 steps to a smaller diameter cylindrical passage 54 to slidingly receive a portion of the insert cylinder 26 of the pick-up tube 16. The radial mounting flange 42 of the tube 16 limits the depth to which the tube may be inserted in the housing 46. The pick-up tube 16 is fixedly secured to the housing 46 by a bolt 56 through the mounting hole 44 in the mounting flange 42 and an aligned mating hole 58 in the mating surface 48 of the housing.

The oil pick-up tube 16 of the present invention minimizes the risk of the o-ring seal 36 rolling off the tube during shipping and handling of the tube prior to assembly with the oil pump 10. This prevents the potential for aspiration of air by the oil pump 10, which may occur if the tube 16 is assembled to the oil pump with the seal 36 inadvertently removed.

The foregoing description of the preferred embodiment of the invention has been presented for the purpose of illustration and description. It is not intended to be exhaustive, nor is it intended to limit the invention to the precise form disclosed. It will be apparent to those skilled in the art that the disclosed embodiment may be modified in light of the above teachings. The embodiment was chosen to provide an illustration of the principles of the invention and its practical application to thereby enable one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

What is claimed is:

1. An oil pump for an automotive engine, comprising:

a housing having a mating surface with a stepped opening, an oil pick-up tube having a pump end received in said stepped opening of said housing and including an insert cylinder of outer diameter D and an oil outlet, an outer diameter d tube portion, and a flared portion tapering from said insert cylinder to said outer diameter d tube portion, said pick-up tube further including a transporting tube portion extending from said pump end to an oil pick-up end, a radial flange about said transporting tube portion which seats against said mating surface of said housing for limiting the depth to which said pick-up tube may be inserted in said housing, and an o-ring seal disposed about said outer diameter d tube portion of said pump end wherein said diameter D of said insert cylinder is greater than said outer diameter d tube portion for keeping said o-ring seal about said pick-up tube prior to assembly in said oil pump.

2. An oil pump, as defined in claim 1, wherein said stepped opening of said housing is comprised of a cylindrical opening to snugly receive said o-ring seal which steps to a smaller diameter cylindrical passage to slidingly receive a portion of said insert cylinder of said pick-up tube.

3. An oil pump, as defined in claim 2, wherein said pick-up tube is fixedly secured to said housing by a bolt through a mounting hole in said radial mounting flange and an aligned mating hole in said mating surface of said housing.

4. An oil pick-up tube for carrying oil from an oil reservoir to an oil pump, comprising:

an oil pick-up end disposed in said oil reservoir, a pump end disposed in said oil pump, and a transporting tube portion to deliver oil from said oil pick-up end to said pump end, said pump end including an insert cylinder having outer diameter D and an oil outlet, an outer diameter d tube portion, and a flared portion tapering from said insert cylinder to said outer diameter d tube portion, said pick-up tube further comprising an o-ring seal disposed about said outer diameter d tube portion, wherein said diameter D of said insert cylinder is greater than said diameter d of said outer diameter d tube portion for keeping said o-ring seal about said tube prior to assembly with the oil pump.

5. An oil pick-up tube, as defined in claim 4, wherein said pump end further comprises a locating formation intermediate said outer diameter d portion and said transporting tube portion, and having an upper surface for axially locating said o-ring seal.

6. An oil pick-up tube, as defined in claim 5, further comprises a radial mounting flange extending about said transporting tube and axially located by a lower surface of said locating formation, for mounting said pick-up tube in said oil pump.

* * * * *